United States Patent [19]

Allen

[11] Patent Number: 5,042,331

[45] Date of Patent: Aug. 27, 1991

[54] METHOD AND APPARATUS FOR REMOVING A CORK OR PLASTIC STOPPER FROM A CHAMPAGNE BOTTLE

[75] Inventor: Herbert Allen, Houston, Tex.

[73] Assignee: Hallen Company, Houston, Tex.

[21] Appl. No.: 189,997

[22] Filed: May 4, 1988

Related U.S. Application Data

[63] Continuation-in-part of Ser. No. 58,566, Jun. 5, 1987, Pat. No. 4,800,783.

[51] Int. Cl.[5] ..... B67B 7/02

[52] U.S. Cl. ..... 81/3.4

[58] Field of Search ..... 81/3.4, 3.07, 3.44, 81/3.09

[56] References Cited

U.S. PATENT DOCUMENTS

| | | | |
|---|---|---|---|
| 2,495,308 | 1/1950 | Amigone | 81/3.44 |
| 2,588,096 | 3/1952 | Eckenboy . | |
| 2,589,693 | 3/1952 | Hess . | |
| 2,641,943 | 6/1953 | Krize, Jr. . | |
| 3,600,982 | 8/1971 | Tholen | 81/3.4 |
| 4,433,597 | 2/1984 | Rowland | 81/3.09 |

FOREIGN PATENT DOCUMENTS

| | | | |
|---|---|---|---|
| 628521 | 4/1936 | Fed. Rep. of Germany . | |
| 655401 | 1/1938 | Fed. Rep. of Germany . | |
| 3304910 | 1/1983 | Fed. Rep. of Germany . | |
| 2367699 | 8/1976 | France . | |
| WO8302265 | 7/1983 | PCT Int'l Appl. . | |
| 149173 | 3/1955 | Sweden | 81/3.4 |
| 10192 | of 1889 | United Kingdom | 81/3.44 |
| 27632 | of 1910 | United Kingdom | 81/3.44 |
| 446080 | 12/1935 | United Kingdom . | |
| 1390299 | 2/1973 | United Kingdom . | |
| 2084549 | 8/1981 | United Kingdom . | |

*Primary Examiner*—Roscoe V. Parker

*Attorney, Agent, or Firm*—Browning, Bushman, Anderson & Brookhart

[57] ABSTRACT

Apparatus and method for removing a stopper from a bottle having an internal pressure greater than the ambient pressure surrounding the bottle, e.g. a champagne bottle. At least one generally vertical edge of the apparatus is placed in a generally vertical groove in the periphery of the stopper, in some cases cutting the groove simultaneously as it is moved downward over the stopper. The apparatus is then oscillated or rotated, whereupon the internal pressure in the bottle can overcome the sliding friction between the stopper and the bottle. The apparatus is also adapted to control the stopper, once expelled.

25 Claims, 5 Drawing Sheets

METHOD AND APPARATUS FOR REMOVING A CORK OR PLASTIC STOPPER FROM A CHAMPAGNE BOTTLE

CROSS REFERENCE TO RELATED APPLICATION

This application is a continuation-in-part of copending U.S. patent application Ser. No. 58,566, filed June 5, 1987 and now U.S. Pat. No. 4,800,783.

BACKGROUND OF THE INVENTION

1. Field of the Invention

The invention relates, generally, to apparatus for removing a bottle stopper, and specifically to apparatus for controlling the removal of a stopper used in bottling champagne or sparkling wines having internal pressures greater than ambient.

2. Description of the Background

The difficulty of removing a cork from a champagne bottle, as well as the difficulty of controlling the cork once it exits from the bottle, are both well known. It has been reported throughout the years, perhaps centuries, that emancipated champagne corks have flown through the air with such force as to cause an untold number of eye injuries to unsuspecting wine stewards.

The task of removing the cork or stopper, however, has baffled those skilled in this art. The prior art is typified by various schemes which call for a vertical lifting force to be applied to the cork, for example, such as is disclosed in U.S. Pat. Nos. 3,761,338; 4,387,609; 4,519,277; 4,437,360; 4,442,735; 4,606,245; 4,519;277; 4,296,653; French Patent No. 1.519.035; and European Patent No. 0164955. A device sold commercially under the name "The Uncorker" appears to be an embodiment of U.S. Pat. No. 4,437,360. Again, each of these prior art devices has concentrated upon the concept of applying a pulling force to the cork or stopper to remove it from the bottle. Pulling a cork in this manner can require a great deal of force.

The device disclosed in U.S. Pat. No. 3,628,405 (for test tube corks), and a device sold commercially under the name "The Champagne Key" have laterally oriented prongs or blades intended to be punched into the cork with a lateral movement, whereafter a lifting force may be applied. Champagne pliers are also known.

U.S. Pat. No. 4,474,087 discloses a device for use on "pop top" type can closures, as well as on screw on type bottle caps. Although it does permit the user to impart a rotary motion to such a screw on cap, it does not appear to be suitable for use on stoppers such as cork or plastic champagne stoppers. U.S. Pat. Nos. 1,752,189; 2,291,866; and 2,323,621 disclose other devices for removing caps from bottles or jars.

SUMMARY OF THE INVENTION

In accord with the present invention, it is unnecessary to apply any external lifting force to the cork. The invention uses the pressure in a champagne bottle. Moreover, the static friction between the sides of the cork and the interior neck of the bottle is much greater than the sliding friction between those same surfaces. By applying a rotary motion to the cork, with no external lifting force, the internal pressure of the bottle overcomes the sliding friction between the cork and the bottle surfaces, and the cork comes right out. The rotary action needed to establish sliding friction is quite easy to apply, compared to a pulling action. In addition, the inventor has discovered that he can make use of the fact that champagne stoppers have wire grooves or indentations in the top.

The invention therefore comprises an apparatus and method which uses one or more edges to engage the grooves in the top of a stopper, and that by then rotating the apparatus with respect to the bottle, the internal pressure of the bottle will overcome the sliding friction of the rotating stopper and the stopper is thus extracted.

The apparatus and method according to the invention also use the edges and/or the center of the apparatus to control the stopper once extracted.

When using the method and apparatus of the present invention with a cork stopper, the edges of the apparatus, if sufficiently sharp knife edges, can make their own indentations or grooves prior to imparting the rotary motion to the cork.

Further features, objects and advantages of the present invention will be better understood from the following detailed description when taken in conjunction with the accompanying drawings.

DETAILED DESCRIPTION OF THE PREFERRED EMBODIMENT

Figure 1:
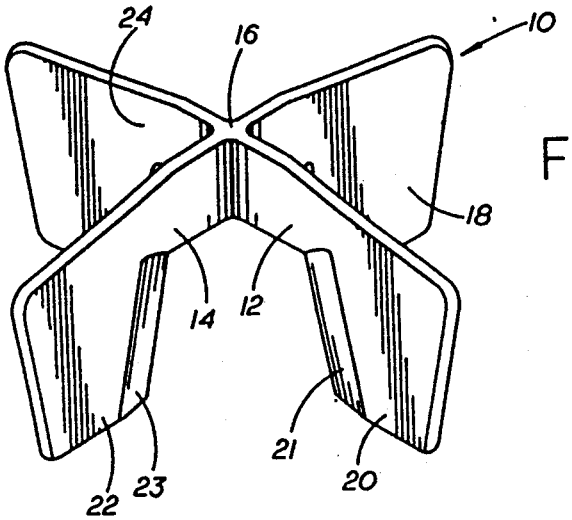
FIG. 1 is an isometric, pictorial view of a first embodiment of the present invention having four orthogonally spaced knife edges.
Figure 2:
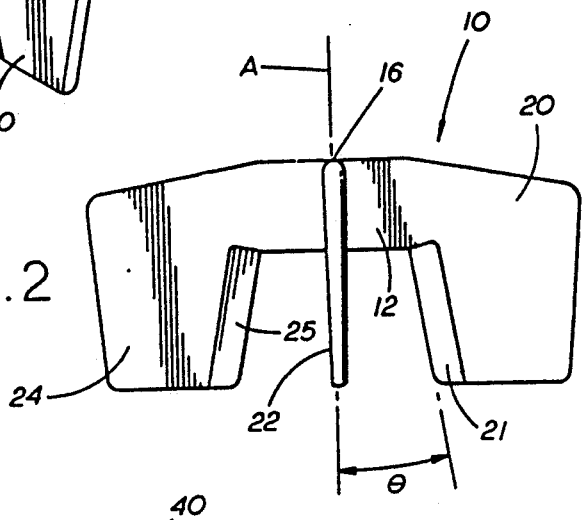
FIG. 2 is a side elevational view of the apparatus illustrated in FIG. 1.

Referring now to FIGS. 1 and 2, there is illustrated an apparatus 10, preferably formed as a single piece, metal body. Although shown as a single body, the apparatus 10 can be considered as a pair of inverted U-shaped members 12 and 14 secured at their midpoint 16, so that their four legs 18, 20, 22 and 24 are disposed at 90° from each adjacent leg. Each of the legs 18, 20, 22 and 24 has a knife edge 19 (not illustrated), 21, 23 and 25

(not illustrated), respectively, with each of the knife edges angled generally upwardly and inwardly toward the axis A through center point 16.

As used herein, words such as "upwardly" and "downwardly" will refer to the position of the apparatus in ordinary use upon an upright bottle, and as shown in the drawings, and should not be construed in a limiting sense. When an edge, surface or other member is said herein to be "generally vertical," as are the edges 19, 21, 23 and 25, this will mean that, if broken down into horizontal and vertical vector components of direction, there is a substantial vertical component.

The knife edge 21 in FIG. 2 is angled upwardly and inwardly through the angle $\theta$ toward the intended rotational axis A of the apparatus 10, coinciding with the longitudinal axis of the cork or plastic stopper and also with the longitudinal axis of the bottle. Although the angle $\theta$ may vary a few degrees, the angle $\theta$ in the embodiment of FIGS. 1 and 2 is approximately 15° to 20°.

The apparatus is preferably designed to engage virtually all common sizes and forms of champagne stoppers. In order to accomplish this, there are several functionally related variables which can be employed. Among the more important of these variables are the length of the edges 19, 21, 23 and 25, the angle $\theta$, and the sharpness of the knife edges. In the embodiment of FIGS. 1 and 2, the inner extremities of the edges 19, 21, 23 and 25 define a frustoconical locus, whose diameter can be easily measured by measuring the distance between two opposed edges, such as edges 21 and 25 as seen in FIG. 2. This frustoconical locus diameter preferably varies from about 0.830 inches at its upper end to about 1.226 inches at its lower end, and this range of diameters allows the device to accommodate the variety of champagne stoppers as mentioned above. It can be seen that, the smaller the angle $\theta$, the longer the edges 19, 21, 23 and 25 have to be in order to provide such a range of diameters.

As mentioned, another factor interplaying with the angle $\theta$ and the length of the edges is the sharpness of the edges. In preferred embodiments, the edges are defined, for purposes of this specification, as "knife edges," i.e. they are capable of cutting or embedding into a cork stopper in a manner to be described more fully below. However, there are also disadvantages to making, or attempting to make, the edges too sharp. The first is the consequent reduction in safety. Another is that, for many of the kinds of materials and manufacturing techniques which would be desirable for such a device, it would be difficult or unduly expensive to make an extremely sharp edge which could be maintained upon repeated usage. The above criteria, including the angle $\theta$ and the range of diameters of the frustoconical locus, assumes a knife edge, but one which is not so sharp as to pose a significant safety problem nor of a degree of sharpness which could not be readily maintained. However, it can be appreciated that, for example, the sharper the knife edges, the wider the angle $\theta$ might be, and the shorter the vertical length of the blades would have to be.

One of the advantages of the embodiment of FIG. 1 is its relatively simple form including its plate-like U-shaped components and generally cruciform configuration as viewed from above, wherein the legs 20, 18, 22 and 24 are connected by the bases of the U-shaped members. This form is relatively simple to manufacture. However, the connecting means formed by the bases of the two U-shaped members occupy a certain lengthwise dimension within the apparatus. Assuming knife edges, but ones which are not unduly sharp, as explained above, then in order to allow for the lengthwise dimension required by the bases of the U-shaped member, while also providing for the desired range of diameters from the top to the bottom of the frustoconical locus defined by the edges, and yet still avoiding excessive length in the device overall, the angle $\theta$ for the embodiment of FIG. 1 is relatively wide, as mentioned about 15°-20°.

Given such an angle $\theta$, it is sometimes necessary for the user to exert a bit more force to emplace the device on the stopper and/or to maintain a slight downward force on the apparatus while using it, in the manner to be described more fully hereinafter.

It should also be noted that where, as in the preferred embodiment shown, the edges are knife edges intended to cut their own grooves, or cut deeper into existing grooves, in a champagne cork, they must have sufficient depth in the radial direction. This radial depth (designated by "R" in FIG. 16 of a subsequent embodiment) should generally be greater than 1/16 inch, but preferably closer to about ⅛ inch. Also the areas lying between adjacent knife edges should be unobstructed so that there is no abutment with the stopper which could limit downward movement of the device, and thus depth of engagement of the edges in the stopper grooves. Thus, if the legs are circumferentially connected, the connecting member(s) should be outside the stopper locus. Or, to put it another way, the knife edges should project inwardly from any such connecting member(s) by more than 1/16 inch, unless, of course, the connecting member(s) are disposed above the stopper locus.

Figure 7:
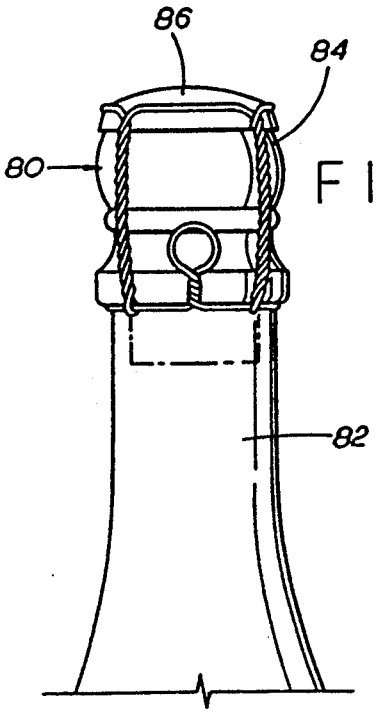
FIG. 7 is a pictorial view of a cork stopper in place in a champagne bottle.
Figure 8:
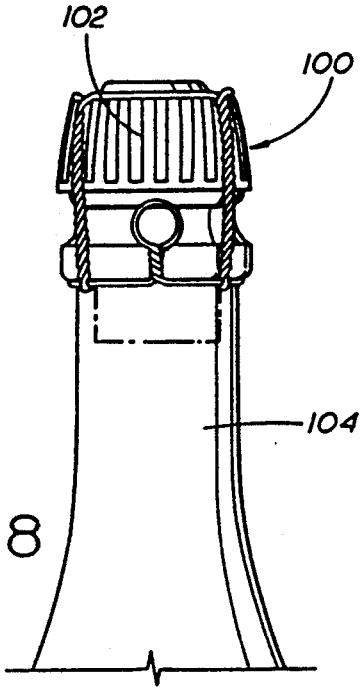
FIG. 8 is a pictorial view of a plastic stopper in place in a champagne bottle.
Figure 9:
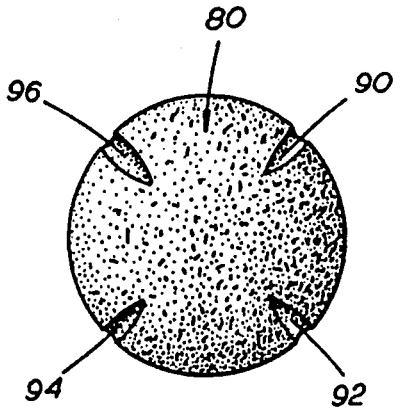
FIG. 9 is a top pictorial view of a cork stopper having four orthogonally spaced grooves.
Figure 10:
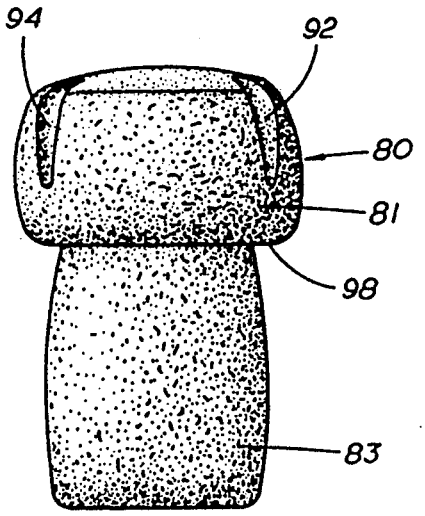
FIG. 10 is a side elevational, pictorial view of a cork stopper removed from a champagne bottle.

FIGS. 7, 9 and 10 illustrate a cork stopper 80, first in place in a champagne bottle 82 as secured by a wire 84. While in place, the cork stopper typically has a metal foil cap 86 which acts to prevent the wire 84 from cutting too deeply into the cork. As best seen in FIG. 10, the stopper 80 has a cap-like head 81, usually about ¾ inch tall, which is disposed above the top of the bottle in use, and a shank 83, which in use extends into the bottle neck sealing the same. As can best be seen in FIGS. 9 and 10, after the wire 84 is removed, there are four orthogonally spaced, generally vertical grooves 90, 92, 94 and 96 in the upper peripheral surface of the cork stopper 80 caused by the wire 84. Plastic champagne stoppers, as illustrated in FIGS. 8 and 11, likewise typically comprise a head 101 and a shank 103.

In the operation of the apparatus illustrated in FIG. 1, the wire 84 is first removed from the top of stopper 80 in the conventional way. The apparatus 10 is then placed downwardly over the top of the stopper 80, such that the knife edges 19, 21, 23 and 25 enter the grooves 90, 92, 94 and 96 in the stopper 80 with a sort of sliding action. Alternatively, the knife edges can cut their own grooves in the top side of the cork stopper, or they can cut deeper into the existing grooves. The apparatus 10 is then rotated, or can be oscillated back and forth a few degrees about the longitudinal axis of the bottle 82 and stopper 80, thus allowing the internal pressure of the bottle 84 to overcome the sliding friction between the stopper and the bottle, thus causing the stopper to be expelled. It should be appreciated that the converging knife edges 19, 21, 23 and 25 and the center 16 of the apparatus 10 will safely control the exit of the stopper 80.

Figure 11:
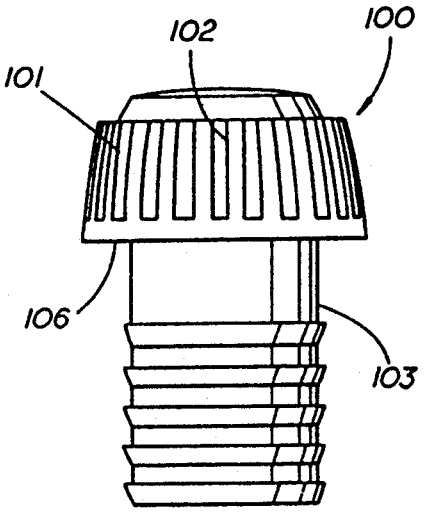
FIG. 11 is a side elevational, pictorial view of a plastic stopper used with champagne bottles.

It should also be appreciated that when the apparatus 10 is used to extract a plastic stopper 100 as illustrated in FIGS. 8 and 11, the knife edges 19, 21, 23 and 25 can be easily inserted into the generally vertical serrations 102 in the plastic stopper. After the knife edges are in the serrations 102, the operation of the apparatus 10 is identical to that described above with respect to the removal of a cork stopper.

A firmer and more satisfactory engagement is obtained if the edges provide a more radial type engagement with the sides of the top 81 of the stopper, as compared to longitudinal type engagement with the upper end of the stopper. Also, it is preferable that the head of the stopper be so engaged well below its upper end.

Figure 3:
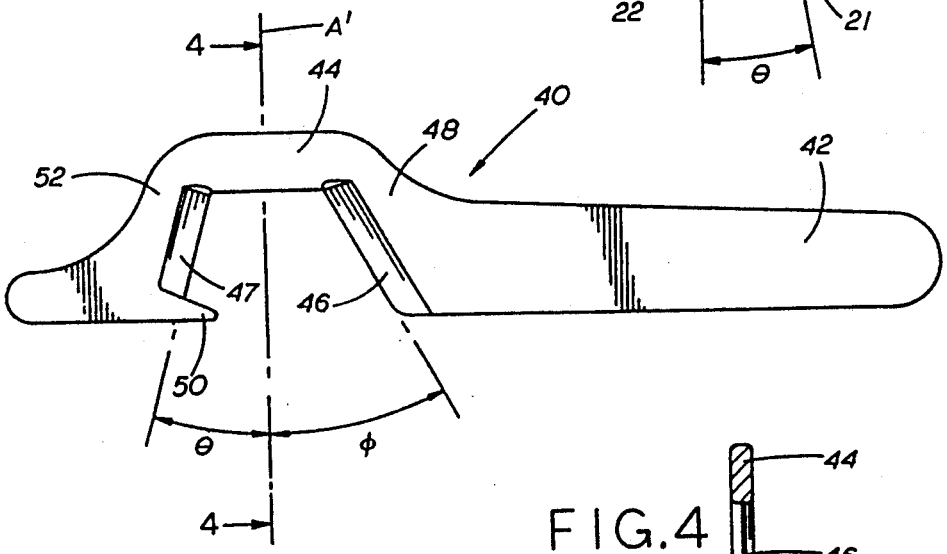
FIG. 3 is a side elevational view of another embodiment of the present invention.
Figure 4:
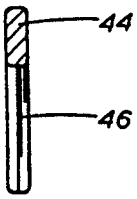
FIG. 4 is a cross-sectional view taken along the lines 4—4 of FIG. 3.

FIG. 3 illustrates another embodiment of the present invention. The apparatus 40 comprises a handle 42 attached to leg 48 of an inverted U-shaped member 44 having a generally vertical knife edge 46 on the leg 48 of the inverted U-shaped member 44, and a generally vertical knife edge 47 on the other leg 52. On the leg 52, at the free, i.e. the end distal the base of the U-shape, there is also a laterally inwardly extending hook-like projection 50. The knife edge 47 is angled upwardly and inwardly through the angle $\theta$ toward the intended rotational axis A', coincident with the centerline of the U-shape. As with the embodiment illustrated in FIG. 2, the angle $\theta$ is approximately 15°, but may vary. The knife edge 46 is angled upwardly and inwardly through the angle $\theta$ towards the axis A'. The preferred angle $\theta$ is approximately 30°, but may also vary. The reason angle $\theta$ is greater than angle $\theta$ is to allow the knife edge 46 to roll or ride over the top of the stopper after first placing the hook 50 under the lower lip 98 of the stopper. As in the case of the apparatus 10 of FIG. 1, the apparatus 40 is preferably made as a single unit, metal body. The vertical dimension of the device between the base 44 of the inverted U-shape and the hook 50 should be sufficient to accommodate the cap-like head 81 or 101 of the champagne stopper.

In the operation of the apparatus 40, handle 42 is angled upward and hook-like projection 50 is placed under the lip 98 of the stopper 80 illustrated in FIG. 10. As the handle 42 is moved downward to a lateral position, with hook 50 providing a pivot point, the knife edge 46 then rides over the top of the stopper and enters one of the grooves 90, 92, 94 or 96, or can make its own groove if a cork stopper is to be removed. Meanwhile, edge 47 enters an opposite groove or makes one of its own. The hook 56, and if necessary, a slight downward pressure on handle 42, control any tendency the apparatus may have to slide upwardly and out of its proper position on the cork or stopper. The handle 42 is then rotated, or oscillated back and forth to expel the cork stopper. When used with the plastic stopper 100 of FIG. 11, the hook 50 is first placed under the lower lip 106 and then the knife edge 46 rolls over the top of the stopper and is placed in one of the serrations 102, followed by the rotation or oscillation of the apparatus 40. It should be appreciated that the angled knife edges 46 and 47 and the shape of U-shaped member 44 will safely control the expulsion of the stopper, whether plastic or cork.

Figure 5:
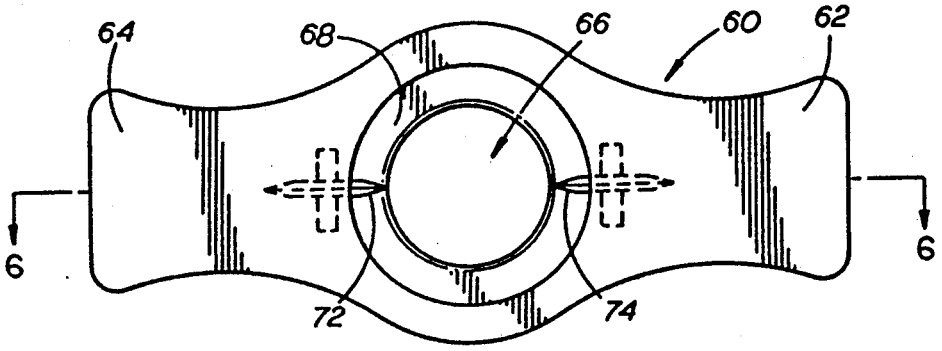
FIG. 5 is a lower plan view of another embodiment of the present invention having a pair of roller knife edges.
Figure 6:
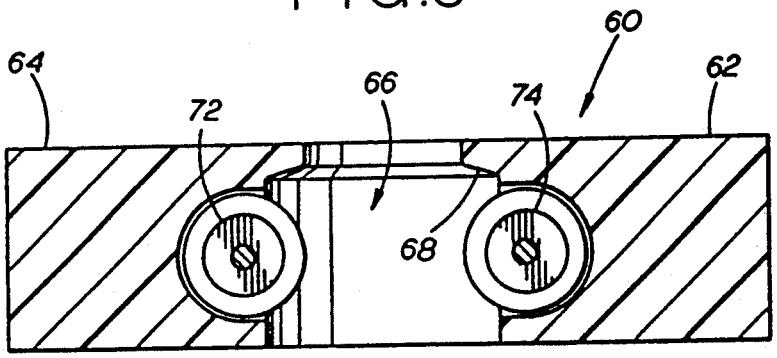
FIG. 6 is a cross-sectional view taken along the lines 6—6 of FIG. 5.

FIGS. 5 and 6 illustrate another embodiment of the present invention. The apparatus 60 comprises a molded plastic body having integral handles 62 and 64 extending laterally outwardly from the body of apparatus 60. A central throughbore 66 is sized to allow the entrance of stoppers 80 or 100. The annular upper flange 68 surrounding throughbore 66 has an internal diameter smaller than the diameter of the stopper, thus providing a control of the stopper once it is expelled from the bottle. On opposite sides of the throughbore 66, a pair of knife-edge rollers 72 and 74 are rotatably mounted so that their edges project into the throughbore and lie generally vertical with respect to the longitudinal axis of the throughbore, and hence the longitudinal axis of the bottle.

In the operation of the apparatus 60, as the device is lowered over the stopper in the champagne bottle, the edges serrations in the cork plastic stopper. The rollers 72 72and 74 are preferably made of metal and can be designed, depending upon the degree of sharpness, to merely roll into the grooves to cut their own grooves, or to dig deeper into the existing grooves, in the case of a cork stopper. Once the rollers 72 and 74 are in a pair of grooves or serrations, the operation is identical to that described above with respect to FIGS. 1 and 3.

Although the innermost edges of the rollers 72 and 74 have only a small vertical extent within the cavity or through bore 66, their lower portions may be considered upwardly and inwardly angled. If it is desired that they engage a fairly wide range of stopper sizes, then it is desirable that they be formed as relatively sharp knife edges. The fact that they roll against, rather than slide against, the stopper allows a fairly good cutting or embedding action without the use of a dangerously sharp edge, and also helps to preserve the degree of sharpness which is imparted to the original edge. They are preferably spaced apart by a distance which will allow them to adequately engage the smallest cork in the intended range, and then they can simply cut or embed into larger corks to accommodate them. In the case of a plastic stopper, as shown in FIGS. 8 and 11, it has been found, rather surprisingly, that the rollers can dig into, or even cut, larger size stoppers so as to achieve adequate engagement.

Figure 12:
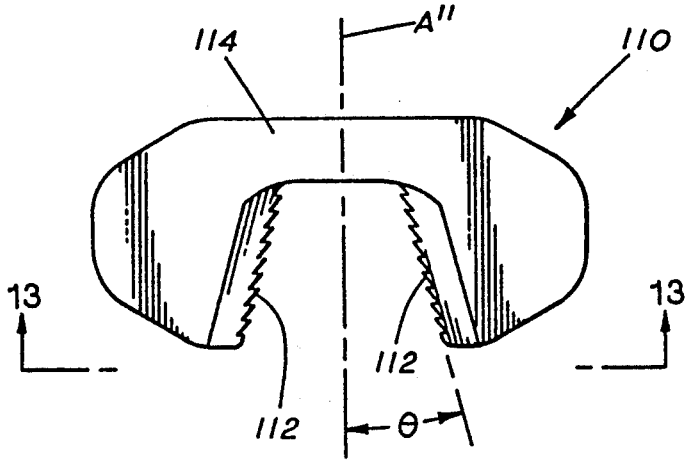
FIG. 12 is an elevation view of another embodiment of the present invention.
Figure 13:
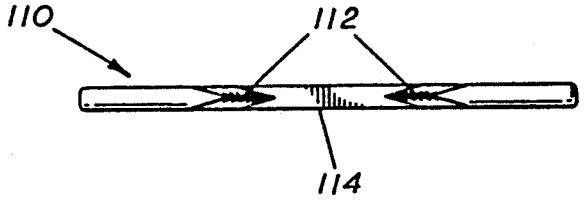
FIG. 13 is a bottom plan view taken on the line 13—13 of FIG. 12.

Referring to FIGS. 12 and 13, there is shown another embodiment of the invention. Whereas the embodiment of FIGS. 1 and 2 has been described as a pair of inverted U-shaped plate-like members orthogonally joined together, the simplified version of FIGS. 12 and 13 is, in essence, a single such inverted U-shaped member 110. The inner edges 112 of the legs of the U are adapted for entering and/or cutting grooves in a champagne cork or serrations in a plastic champagne stopper, as described in connection with the other embodiments hereinabove. More specifically, edges 112 are angled upwardly and inwardly toward the axis A" of the device. This angling, in itself, is sufficient to control the cork or stopper as it emerges from the bottle. However, the base 114 of the U-shaped member extends laterally across the locus of the axis, thus providing even more certain control, while also enabling the device to be simply formed as a plate-like member.

Edges 112 are diametrically opposed, and thus, each provides an abutment opposed to the other, enabling a firm wrench-like engagement with the cork or stopper.

Edges 112 differ from those of the first embodiment in that they are serrated, with the serrations preferably being angled upwardly. This feature provides for even firmer engagement of the device with a cork or stopper as well as resisting any tendency of the device to slide back upwardly along the stopper, and thus minimize the necessity to apply a downward force while using the device. The upward angling of the serrations helps to facilitate emplacement of the device down over the cork or stopper. Rather surprisingly, this angling of the serrations does not unduly interfere with removal of the device from the cork or stopper after the latter has been removed from the bottle, and in particular, it has been found that there is no excessive or messy damage to the cork.

In addition, the use of serrations on the edges 112 allows those edges to be disposed at a relatively large angle $\theta$ with respect to the axis A'', thereby minimizing the length of the device.

Otherwise, the use of the device of FIGS. 12 and 13 is generally the same as for the embodiment of FIGS. 1 and 2. In particular, it is noted that the serrated edges 112 can also be knife edges sufficiently sharp to cut or deepen grooves in a champagne cork.

Figure 14:
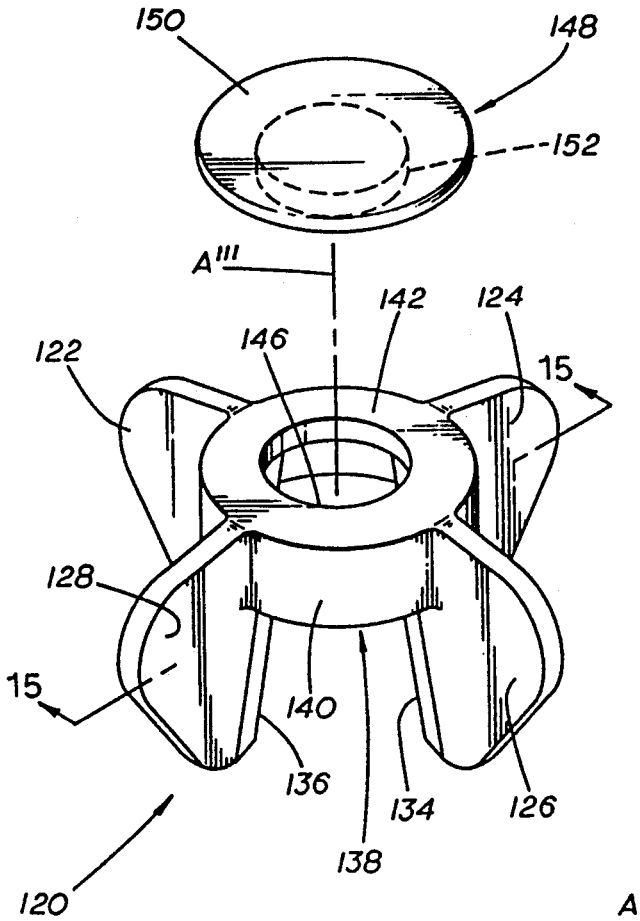
FIG. 14 is an exploded perspective view of another embodiment of the present invention.
Figure 15:
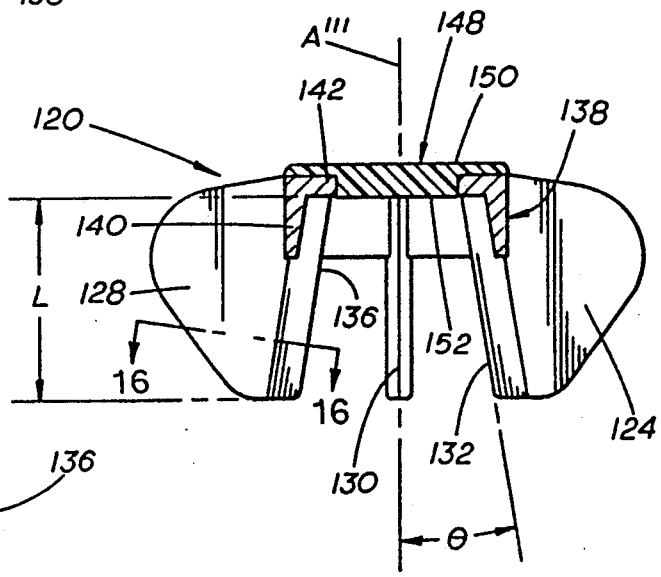
FIG. 15 is a vertical cross-sectional view taken on the line 15—15 of FIG. 14.
Figure 16:
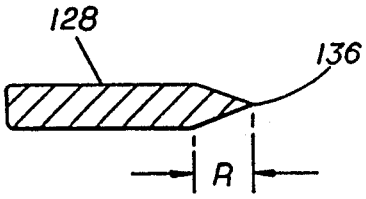
FIG. 16 is a detailed cross-sectional view taken on the line 16—16 of FIG. 15.

Referring finally to FIGS. 14–16, there is shown another embodiment of the invention. Like the embodiment of FIGS. 1 and 2, this embodiment includes an integral body 120 having four legs 122, 124, 126 and 128, in the form of vertically oriented plate-like members, orthogonally spaced from one another, and also radially spaced, with respect to the axis A'' of the device. Likewise, as in the first embodiment, the legs have respective edges 130, 132, 134 and 136 running along their inner sides. These edges are preferably of a similar degree of sharpness as in the first embodiment, i.e. sharp enough to form a knife edge capable of cutting or embedding into a cork stopper, but not so sharp as to be unduly dangerous to the user nor to be easily and quickly dulled after a number of uses.

Unlike the first embodiment, the legs 122, 124, 126 and 128 are not connected by continuations of their own plate-like form, but rather, are connected by a connecting ring 138. Ring 138 may be integrally cast or molded with the legs 122–128, and comprises a downwardly depending skirt 140 and a flange 142 extending radially inwardly from the upper end of skirt 140. It is noted that, as shown in FIG. 15, the edges 130–136 extend upwardly into ring 138, along the inner surface of skirt 140, to the underside of flange 142.

As mentioned, while the embodiment of FIGS. 1 and 2 has an advantage in terms of its simplicity of construction, the vertical plate-like form of the means for connecting the legs, of necessity, occupies a significant vertical space, and contributes to the overall length of the device to that extent. Thus, to make a conveniently sized and aesthetically appealing device, it may be necessary to make the edges of the first embodiment somewhat shorter than that which would permit the use of a relatively small angle $\theta$, and this in turn may require the exertion of a bit more force in placing the device over the stopper, and the maintenance of a slight downward force while using the device.

By way of contrast, although it may be somewhat more expensive to manufacture, the embodiment of FIGS. 14-16 allows the edges 130–136 to extend upwardly into and along the skirt 140, thereby effectively increasing the edge length without a corresponding increase in the overall length of the device.

Accordingly, a smaller angle $\theta$ can be employed in the device of FIGS. 14–16 without increasing the overall length of the apparatus. More specifically, using the construction of FIGS. 14–16, and an overall length comparable to that of the embodiment of FIGS. 1 and 2, it is easily possible to use an angle $\theta$ less than 15°. Preferably, $\theta$ is less than or equal to 12°, and even more preferably, the angle may ideally be in the range of 8°–10°, inclusive, depending upon other factors such as the material of which the device is formed and the sharpness of the knife edges.

Assuming a reasonably but not unduly sharp knife edge, as described above, and further assuming that the device is made of steel or a similar metal, it has been found that with an angle $\theta$ between 8° and 10° inclusive, and an edge length L of about $1\frac{1}{8}$ to $1\frac{1}{4}$ inch, the device can easily be pushed down over any common form of champagne stopper known to the present inventor, will achieve adequate radial interengagement of the edges 130–136 and the grooves in the stopper, and will remain in its proper position without the exertion of any substantial downward force. It is believed that, given the same angle and edge length, similar results would be obtained with devices made of other suitable materials, such as plastics.

It is believed that several factors may contribute to the results just mentioned. First, an angle $\theta$ of less than 12° is clearly less than the angle of static friction (angle whose tangent is the coefficient of static friction) for steel on cork (as estimated using the available coefficients for steel on wood and steel on leather). Although there are no doubt other factors effecting the tendency of the device to slide back up along the stopper after it has been placed thereon, utilizing an angle $\theta$ below the appropriate angle of friction seems to provide a device safely within the overall set of parameters which eliminate the need for the exertion of downward force during use. Since the coefficients of static friction for other pairs of materials which might reasonably come into play, e.g. steel (edges) against plastic (stopper) or plastic (edges) against cork or plastic (stopper), would appear to be no greater than for steel on cork, an angle $\theta$ less than 12° is a "safe" choice for most embodiments of this invention.

Another reason that an angle $\theta$ less than 12°, and even more preferably in the range of 8°–10°, inclusive, makes for easier emplacement and retention of the device on the stopper may be that such an angle places the edges more nearly parallel to the stopper, or a tangent to the stopper, at the point of engagement. This also gives more linear, as opposed to point, contact with the stopper.

Still another factor is that, the more nearly vertical is the disposition of the edges, the better their opposition and their radial, by way of contrast to longitudinal, engagement with the stopper. This gives the user the feel of having a firm grasp of the stopper, and provides for an excellent wrench-like action of the device on the stopper whereby the latter can be rotated.

However, if the angle $\theta$ is made too small, so that the edges become too nearly parallel, then it is difficult to provide a device which will properly engage a wide range of stopper types and sizes without unduly lengthening the device. The ultimate example would be an embodiment in which the edges were truly parallel, in which case the ability to engage different sizes of stoppers would be determined exclusively by the depth to which the edges could pass into and/or cut the grooves in the stopper.

Accordingly, all of these factors being considered, the present inventor has found an angle $\theta$ in the range 8°–10° to be particularly effective.

Referring again to FIGS. 14 and 15, the body 120 could be used alone as an embodiment of the present invention. However, the flange 142 defines a central opening 146 which can be used to mount a closure member 148. More specifically, member 148 has a disk-like upper part 150 whose upper surface is sized to precisely overlie the connecting ring 138. In addition, member 148 includes a downwardly depending hub 152 which may be press fitted into the bore 146 in flange 142.

The closure member 150 provides a more finished and attractive appearance for the device. The member 148 may be formed of suitable plastic materials, which can be provided in many different colors, and even provided with two-tone printed designs or the like, especially on the upper surface thereof. Thus, the member 148 can substantially enhance the beauty of the device, and can also be used as a site for imprinting logos and the like. This in turn provides a simple way of customizing the device for different retailers or other customers, while still permitting a common manufacturing facility and technique for the main body 120.

Thus, there have been described herein several embodiments of the present invention which can be used to safely remove a champagne stopper without using any external pulling force. Although the specification refers generally to the removal of a stopper from a champagne bottle, the invention can be used in removing a stopper from any bottle having a sufficient internal pressure to overcome the sliding friction between the stopper and the interior neck of the bottle.

Obvious variations of the preferred embodiment will become apparent from a reading of the foregoing specification. Although "knife edges" are used in the preferred embodiments, those skilled in the art will immediately recognize that the degree of sharpness can vary considerably, from razor sharp to well rounded, depending upon the extent to which a cutting action is desired. Thus, the invention in its broadest aspects contemplates the use of means to enter and utilize the preformed grooves or serrations to rotate the stopper, without regard for the sharpness of the edges or members being used. Moreover, although the second preferred embodiment contemplates the use of a hook, those skilled in the art will recognize that other types of abutments can be used on one side of the stopper opposed to a knife edge to enable rotation of the stopper.

Still other modifications will suggest themselves to those of skill in the art. Accordingly, it is intended that the scope of the invention be limited only by the following claims.

What is claimed is:

1. An apparatus for removing a stopper from a bottle of champagne or other sparkling wine, the apparatus comprising a plurality of generally vertically oriented members circumferentially spaced from each other about a central axis, each of the members having two side surfaces converging to form a radially inner edge of the respective member, wherein the edges are angled upwardly and inwardly toward the axis, and further comprising means connecting the edges while leaving a void area therebetween on the axis, the void area being a generally frustoconical locus defined by the edges and centered on the axis, the diameter of said locus varying in the range from about 0.83 inch to about 1.226 inch from its upper end to its lower end.

2. The apparatus according to claim 1 wherein the edges are knife edges.

3. An apparatus for removing a stopper from a bottle of champagne or other sparkling wine, the apparatus comprising a plurality of generally vertically oriented members circumferentially spaced from each other about a central axis, each of the members having two side surfaces converging to form a radially inner edge of the respective member, each edge having a radial depth greater than about 1/16 inch, and wherein the edges are angled upwardly and inwardly toward the axis, and further comprising means connecting the edges while leaving a void area therebetween on the axis.

4. The apparatus of claim 3 wherein the radial depth is about ⅛ inch.

5. An apparatus for removing a stopper from a bottle of champagne or other sparkling wine, the apparatus comprising a plurality of generally vertically oriented members circumferentially spaced from each other about a central axis, each of the members having two side surfaces converging to form a radially inner edge of the respective member, wherein the edges are angled upwardly and inwardly toward the axis, and further comprising connecting means connecting the edges while leaving a void area therebetween on the axis, wherein the connecting means extend across the upper end of the void area forming an inverted U-shape with two of the edges.

6. The apparatus according to claim 5 wherein the U-shaped member is a relatively thin plate-like member.

7. The apparatus according to claim 6 wherein the edges are disposed at about 15° to 20° to the axis.

8. An apparatus for removing a stopper from a bottle of champagne or other sparkling wine, the apparatus comprising a plurality of generally vertically oriented members circumferentially spaced from each other about a central axis, each of the members having two side surfaces converging to form a radially inner edge of the respective member, wherein the edges are angled upwardly and inwardly toward the axis, the angle between the edges and the axis being less than 15°, and further comprising means connecting the edges while leaving a void area therebetween on the axis.

9. The apparatus according to claim 8 wherein the angle between the edges and the axis is less than or equal to 12°.

10. The apparatus according to claim 9 wherein the angle between the edges and the axis is in the range of 8° to 10°, inclusive.

11. The apparatus according to claim 9 wherein the connecting means comprises an annular connecting ring adjoining the edges.

12. The apparatus according to claim 11 wherein the upper portions of the edges extend along an inner surface of the connecting ring.

13. The apparatus according to claim 12 wherein the angle between the edges and the axis is in the range of 8° to 10°, inclusive.

14. An apparatus for removing a stopper from a bottle of champagne or other sparkling wine, the apparatus comprising a plurality of generally vertically oriented members circumferentially spaced from each other about a central axis, each of the members having two side surfaces converging to form a radially inner edge of the respective member, wherein the edges are angled upwardly and inwardly toward the axis, and further comprising means connecting the edges while leaving a void area therebetween on the axis, the connecting means comprising an annular connecting ring adjoining the edges, the upper portions of the edges extending along the inner surface of the connecting ring.

15. The apparatus according to claim 14 wherein the connecting ring comprises a lower skirt portion and an upper flange extending radially inwardly from the upper end of the skirt and above the edges.

16. An apparatus for removing a stopper from a bottle of champagne or other sparkling wine, the apparatus comprising a plurality of generally vertically oriented members circumferentially spaced from each other about a central axis, each of the members having two side surfaces converging to form a radially inner edge of the respective member, wherein the edges are angled upwardly and inwardly toward the axis, and further comprising means connecting the edges while leaving a void area therebetween on the axis, the connecting means comprising an annular connecting ring adjoining the edges, and the apparatus further comprising a closure member mounted in the upper end of the bore of the connecting ring.

17. The apparatus according to claim 16 wherein the closure member is press-fitted into the bore.

18. The apparatus according to claim 16 wherein the closure member has an upper surface overlying the connecting ring.

19. An apparatus for removing a stopper from a bottle of champagne or other sparkling wine, the apparatus comprising a plurality of generally vertically oriented members circumferentially spaced from each other about a central axis, each of the members having two side surfaces converging to form a radially inner edge of the respective member, the two side surface of each member being symmetrical with respect to a radial plane, wherein the edges are angled upwardly and inwardly toward the axis, the angle between the edges and the axis being less than the angle of friction for the materials of which the edges and the stopper, respectively, are formed, and further comprising means connecting the edges while leaving a void area therebetween on the axis.

20. The apparatus according the claim 19 wherein the upper ends of the edges are aligned transversely of the axis, the lower ends of the edges are aligned transversely of the axis, and each of the edges is disposed at the same angle as the other edges with respect to the axis.

21. The apparatus according to claim 20 wherein the angle between the edges and the axis is less than 15.

22. The apparatus according to claim 21 wherein the angle between the edges and the axis is less than or equal to 12°.

23. The apparatus according to claim 22 wherein the angle between the edges and the axis is in the range of 8° to 10°, inclusive.

24. An apparatus for removing a stopper from a bottle having an internal pressure greater than the ambient pressure surrounding the bottle, the apparatus comprising a plurality of edges circumferentially spaced from each other about a central axis, the edges being angled upwardly and inwardly toward the axis, an annular connecting ring connecting the edges while leaving a void are therebetween on the axis, the connecting ring including a lower skirt portion and an upper flange extending radially inwardly to define a cylindrically-shaped bore, the upper portions of the edges extending along an inner surface of the connecting ring, and a closure member for fitting within said cylindrically-shaped bore.

25. An apparatus for removing a stopper from a bottle of champagne or other sparkling wine, the apparatus comprising a plurality of generally vertically oriented members circumferentially spaced from each other about a central axis, each of the members having two side surfaces converging to form a radially inner edge of the respective member, each edge being serrated, with the serrations angled upwardly, and wherein the edges are angled upwardly and inwardly toward the axis at about 12° to the axis, and further comprising means connecting the edges while leaving a void area therebetween on the axis.

* * * * *